United States Patent [19]

Ciccotelli

[11] Patent Number: 4,767,368

[45] Date of Patent: Aug. 30, 1988

[54] SWIM FIN WITH HINGED, SPRING-BIASED BLADE DISPLACED FROM TOE OF FOOT POCKET

[76] Inventor: Stephen S. Ciccotelli, P.O. Box 1414, Deming, N. Mex. 88031

[21] Appl. No.: 115,660

[22] Filed: Oct. 27, 1987

Related U.S. Application Data

[63] Continuation of Ser. No. 911,798, Sep. 26, 1986, abandoned, which is a continuation-in-part of Ser. No. 842,282, Mar. 21, 1986, Pat. No. 4,657,515.

[51] Int. Cl.[4] ..... B63H 5/12
[52] U.S. Cl. ..... 441/64
[58] Field of Search ..... 441/60–64

[56] References Cited

U.S. PATENT DOCUMENTS 3,665,535 5/1972 Picken ..... 441/64

FOREIGN PATENT DOCUMENTS 1245395 9/1960 France ..... 441/64
451049 4/1950 Italy ..... 441/62

*Primary Examiner*—Sherman D. Basinger
*Assistant Examiner*—Jesûs D. Sotelo
*Attorney, Agent, or Firm*—Cahill, Sutton & Thomas

[57] ABSTRACT

A swim fin including a foot pocket has a rigid blade pivotally attached to a spring-biased strut assembly, one end of which is attached to the toe of the foot pocket, the other end of which is attached to the leading edge of the rigid blade. In one form the swim fins are provided as a pair, the blade of one having its trailing edges inclined, the leading edge of the blade of the other fin having leading edges inclined to accommodate the trailing edge of the other fin. The hinge point of one fin is located farther from the toe of the foot pocket than is the case for the other fin so that the swim fins can be used without their blades striking each other. The structure requires a minimum amount of energy for blade angle reversal during swimming.

10 Claims, 2 Drawing Sheets

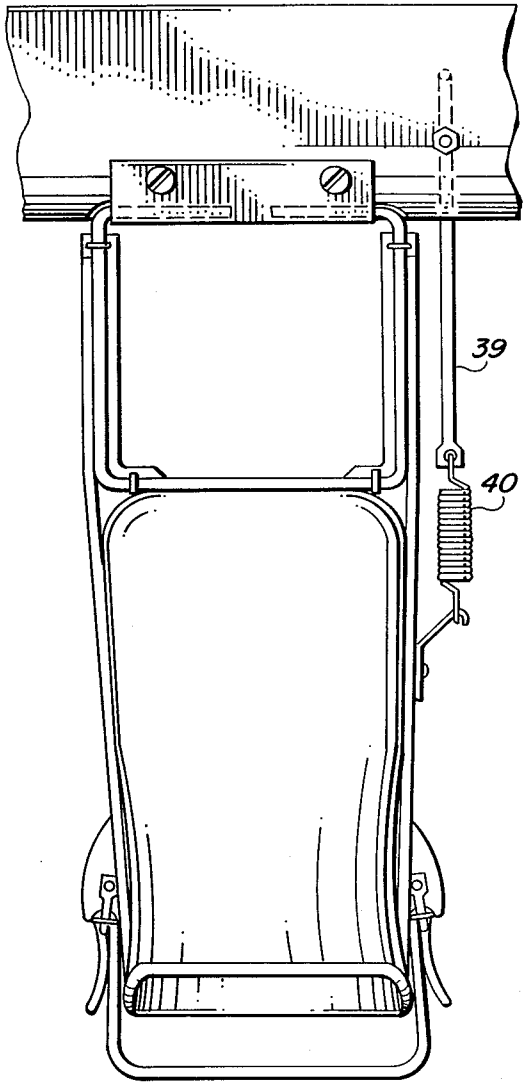
Fig. 7
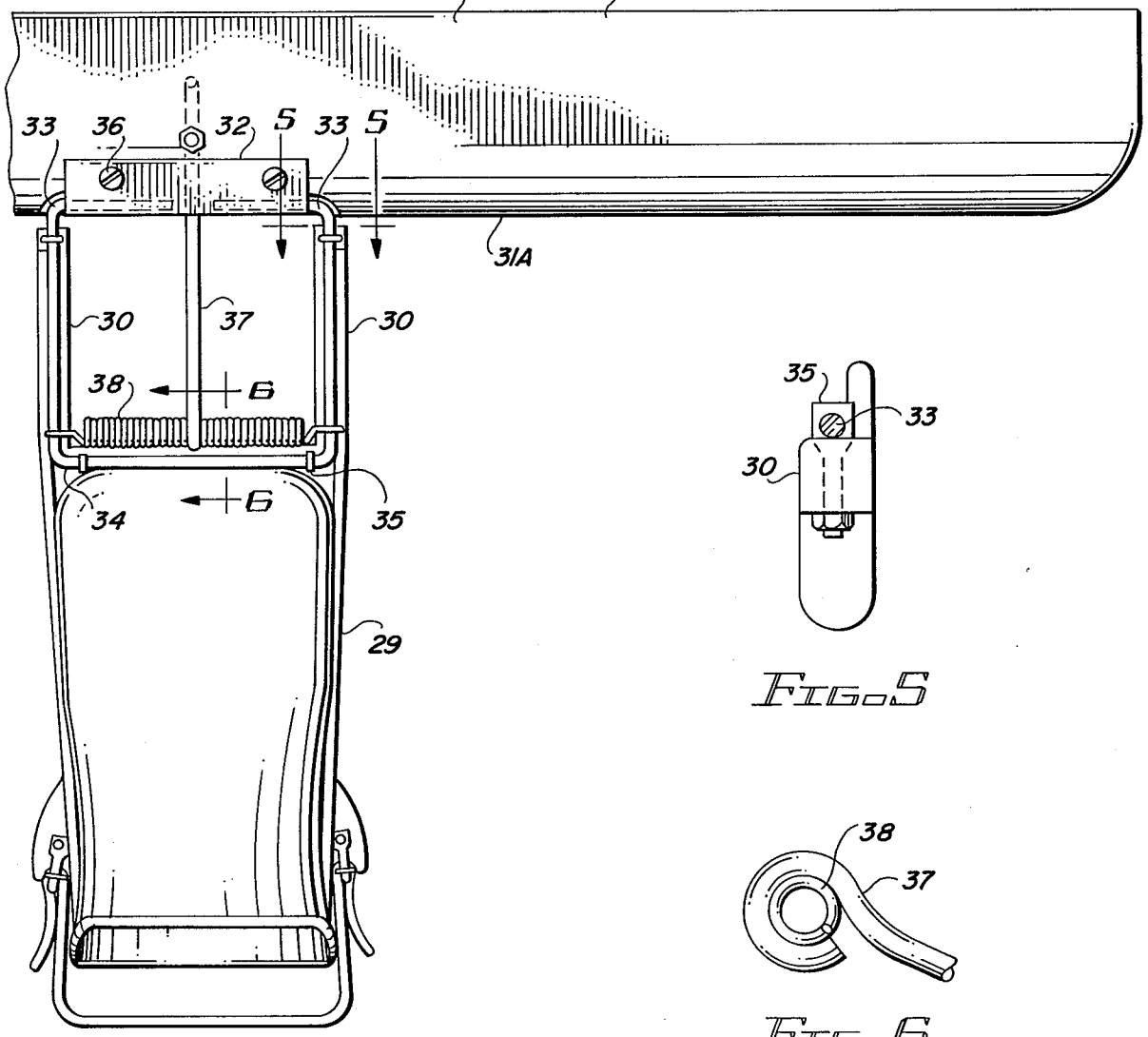
Fig. 4
Fig. 5
Fig. 6

SWIM FIN WITH HINGED, SPRING-BIASED BLADE DISPLACED FROM TOE OF FOOT POCKET

This application is a continuation of Ser. No. 911,798, filed Sept. 26, 1986, now abandoned, which is a continuation in part of my patent application entitled "IMPROVED SWIM FIN", Ser. No. 842,282, filed Mar. 21, 1986, now U.S. Pat. No. 4,657,515, issued Apr. 14, 1987 incorporated herein by reference and is also related to my copending allowed patent application Ser. No. 798,676 entitled "SWIM FIN", filed Nov. 15, 1985.

BACKGROUND OF THE INVENTION

This invention relates to swim fins of the type having a rigid blade with a leading edge and a trailing edge and having the rigid blade supported from a foot pocket so that a space exists between the foot pocket and the rigid blade.

In above-referenced prior patent application Ser. No. 842,282, a swim fin of this type was illustrated using a narrow streamlined rigid blade with an 18 inch blade span. This type of blade is very efficient but it forces the swimmer to swim with his feet apart at a greater distance than 18 inches to allow the blade tips to clear each other.

SUMMARY OF THE INVENTION

It is an object of this invention to provide a swim fin with a rigid blade which has a blade span of 18 inches but can be used for swimming in the normal way, that is, without having the swimmer increase the spacing between his feet.

It is another object of this invention to provide a swim fin that can be stroked efficiently in the fashion of a dolphin, that is, moving both feet together rather than in opposite directions, in addition to the normal swimming stroke It is a further object of this invention to provide a swim fin which is designed to be used with the dolphin style swim stroke exclusively.

The efficiency of the conventional swim fin is quite poor when used with the dolphin type of swimming stroke primarily because of low blade efficiency and relatively high drag that is generated when the blade angle is reversed at the end of each stroke.

In its broadest aspect, the first form of the present invention includes a pair of swim fins with each swim fin having a rigid blade with a large blade span and a leading and trailing edge, positioned at different distances from the foot pocket and shaped to clear the other blade during swimming. While in the second form, the blade of each swim fin is positioned the same distance from its foot pocket and during swimming both feet are moved together, thereby permitting a maximum blade span of about 2½ feet. Each blade is pivotally attached to a rigid extension of a foot pocket which is long enough so that a space exists between the blade and the foot pocket. The pivot point for each blade is located on a center portion of the leading edge of the blade. Springs supply the resilient force to the blades for the finning action.

Other features and advantages not specifically enumerated above will be apparent after consideration of the following detailed description and appended claims.

The preferred form which the invention may assume is illustrated in the accompanying drawings.

BRIEF DESCRIPTION OF THE DRAWINGS

FIG. 4 is a plan view of another embodiment of the invention.

FIG. 5 is a view taken at 5—5 of FIG. 4.

FIG. 6 is a view taken at 6—6 of FIG. 4.

FIG. 7 is similar to FIG. 4 but illustrating a different spring mechanism.

DESCRIPTION OF THE INVENTION

Figures 1, 2, 3:
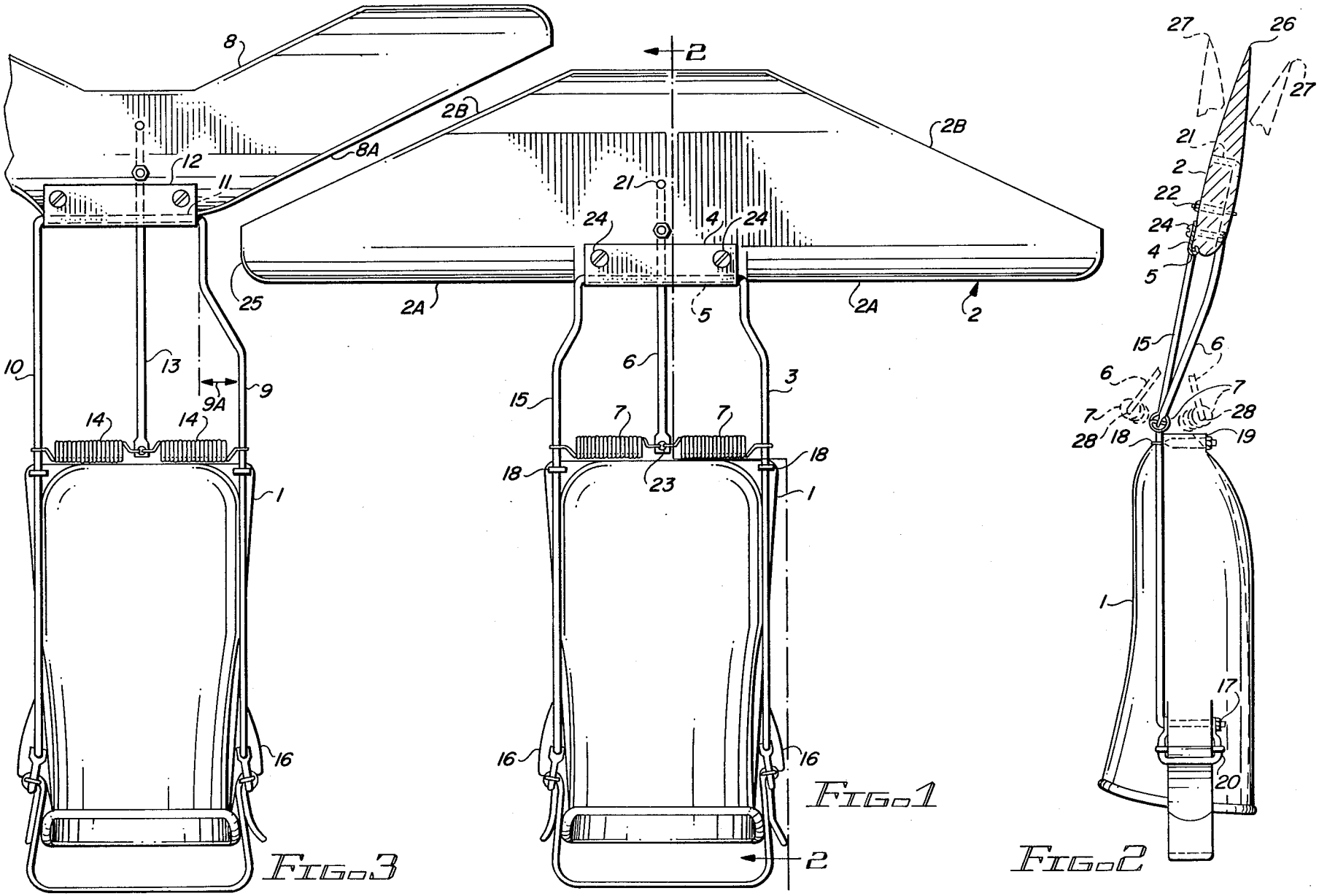
FIG. 1 is a plan view of one of the swim fins of the invention in which the blade is closest to the foot pocket.
FIG. 2 is a partial sectional view taken at 2—2 of FIG. 1.
FIG. 3 is a plan view of the other swim fin.

In order for a swim fin to perform well with a dolphin swimming stroke, the swim fin of the present invention incorporates the following five design points:

1. The blade should be narrow, rigid and have a long blade span, and for optimum efficiency both the leading and trailing edges of the blade should be perpendicular to the center line of the swim fin. This type of blade requires a minimum amount of blade surface and requires a minimum amount of energy for blade angle reversal. In conventional swim fins the blade is about 11 inches or more measured from the foot pocket to the tip of the blade and the blade area is about 95 square inches. Thus, both the quantity and the velocity of water moved during blade angle reversal is comparatively high.
2. The hinge point for the blade should be located at the leading edge of the blade or close to it to minimize the amount of energy expended during blade angle reversal. In conventional swim fins the hinge action occurs at a point near the foot pocket.
3. The blade support should be attached to the center portion of the leading edge of the blade.
4. A spring mechanism is required to provide a spring force to maintain the blade in the neutral position and to resist blade deflection.
5. Finally, to facilitate blade angle reversal, the blade should be positioned so that a space exists between the foot pocket and the blade. There are two reasons for this:
   a. Any blade surface near the foot pocket generates excessive drag during blade angle reversal.
   b. There is turbulence directly behind the foot pocket. In conventional swim fins there is no large space between the foot pocket and the blade.

By incorporating the above requirements and by designing two differently shaped blades and positioning them at different distances from the foot pocket so that they clear each other during swimming, a swim fin is provided which can be used for both conventional and dolphin style swimming strokes.

Referring to the drawings for the first embodiment of the swim fin in detail, in FIG. 1 the swim fin includes a foot pocket 1, a rigid blade 2, two struts 3 and 15, a hinge plate 4, a hinge pin 5, a strut 6 for the spring mechanism and two springs 7.

In FIG. 3 the swim fin also includes a foot pocket 1 which is the same as in FIG. 1, a rigid blade 8, a strut 9, a strut 10, a hinge pin 11, a hinge plate 12, a strut for the spring mechanism 13, and two springs 14. The blade 8 of FIG. 3 is farther away from the foot pocket than blade 2 of FIG. 1, and has its leading edges 8A on either side of the hinge plate 12, inclined rearward and outward from the foot pocket 1, giving the blade 8 a generally V-shaped configuration.

The blade 2 of FIG. 1, on the other hand, has its leading edges 2A perpendicular to the longitudinal axis of the fin, and its trailing edges 2B, rather than its leading edge, inclined. The edges 2B are inclined from the left and right ends of blade 2 toward a narrowed, blunt trailing end. Blade 2 has more surface area to help compensate for the fact that blade 8 of FIG. 3 is farther from the foot pocket 1 and therefore requires more effort to move it through the water.

Referring to FIG. 1, blade 2 is supported at a point away from the foot pocket 1 by the two struts 3 and 15 that project from the foot pocket 1. The struts 3 and 15 and the hinge pin 5 are made as a generally U-shaped wire form, the outer end of which passes through hinge plate 4. Hinge plate 4 is attached to blade 2 by two fasteners 24, and the ends of the wire form 3 and 15 are bent 90 degrees for insertion through the buckles 20 (FIG. 2) and into the hole in the bosses 16 for the buckles 20. The ends of the wire forms 3 and 15 are threaded for stop nuts 17, as illustrated in FIG. 2.

The parts of the wire forms 3 and 15 that project from the foot pocket are angled with respect to the foot pocket so that during swimming the blade is approximately parellel to the swimmer's leg. This is illustrated in FIG. 2. This construction increases efficiency because it positions the blade 2 at an angle that is closest to the desired angle in which the blade deflects about as much on the down stroke as on the up stroke.

Near the toe of the foot pocket there are two long holes to accept fastener 18. Fastener 18 has a hole in one end through which the wire forms 3 and 15 pass, and is threaded on the other end for stop nut 19.

A strut 6, illustrated in FIG. 2, projects from the blade 2 and has its end bent 90 degrees for insertion into a hole 21 in blade 2. A fastener 22, the same type as fastener 18, clamps the strut 6 against a groove in the underside of the blade 2. At the lower extremity of strut 6 as shown in FIG. 1 is a hole 23 through which two springs 7 are hooked. The other ends of the springs 7 are hooked onto struts 3 and 15.

The general design of the other swim fin of the pair is illustrated in FIG. 3, and is similar to that of the swim fin of FIG. 1, but since blade 8 is located farther away from the foot pocket, thereof, struts 9 and 10 and strut 13 of the spring mechanism are longer than for the swim fin of FIG. 1. Also, strut 9 has a pronounced offset 9A to give the blade tip 25 of blade 2 more clearance space. The foot pocket 1 of FIG. 3 is identical to foot pocket 1 of FIG. 1. Hinge plate 12 is identical to hinge plate 4. The struts 9 and 10 are connected to foot pocket 1 of FIG. 3 in the manner of FIG. 1, and the hinge plate 12 and strut 13 are also connected in the manner of FIG. 1.

Referring to FIG. 2, the operation of the swim fin is as follows:

During swimming, the trailing edge 26 of the blade 2 oscillates in an arc shaped path having its center at hinge pin 5. Two springs 7 and a strut 6 comprise the spring mechanism. The function of the spring mechanism is to center the blade 2 when it is unstressed and provide a spring force when it is stressed during swimming for the required finning action. This finning action is illustrated in FIG. 2. As the trailing edge 26 of blade 2 swings to point 27, the extremity of strut 6 to which springs 7 are attached, swings to points 28 thereby stretching the springs 7. When the blade is unstressed the springs contract and the trailing edge of the blade returns to the unstressed position 26. The spring force can be adjusted to suit the swimmer by changing springs. The wire form is made of high strength corrosion-resistant wire having a minimum diameter of 0.188 inches.

The wire form has four functions:

1. To support the blade at a point way from the foot pocket.
2. To provide a hinge pin for the spring mechanism and the hinge plate.
3. To provide points for connection of the ends of springs 7.
4. To provide a pin for the strap buckle.

To avoid the severe stresses that occur when the swimmer walks while wearing the fins, the described swim fin has the following features:

1. The wire form is attached to the foot pocket at a point high up on the sides of the foot pocket, illustrated in FIG. 2.
2. The wire form is attached to the toe of the foot pocket with only two fasteners to give the wire form some flexibility at this point.
3. The wire form extends all the way to the bosses 16 for the strap buckle. This construction adds length to the wire form to obtain a degree of flexibility which is needed should the swimmer trip or should the swimmer's foot come down at an angle while wearing the fins.
4. The wire form projects directly forward from the foot pocket to the center portion of the blade to which it is pivotally attached.

With this configuration the required length and diameter of the projecting part of the wire form is minimal and therefore the stresses in the wire form, the weight of the wire form, and the drag generated by the wire form is minimal.

Referring to the drawings of the second embodiment of the present invention in detail, in FIG. 4 the swim fin comprises a foot pocket 29, two beams 30 molded to the foot pocket and projecting forward therefrom, a rigid blade 31 having a leading edge 31A and a trailing edge 31B, a hinge plate 32, two wire struts 33 and a cross-member 34, the two wire struts and the cross-member being constructed as a U-shaped wire form with the ends being bent 90 degrees for insertion into the hinge plate 32. The wire form is attached to the molded beams 30 and to the foot pocket 29 by fasteners 35, and the hinge plate 32 is attached to the blade 32 by fasteners 36. The spring mechanism comprises a strut 37 attached to the blade 31 and projecting toward the foot pocket and a single spring 38. The extremity of strut 37 is formed into a loop to accept the spring 38 and each end of the spring 38 is connected to a strut 33. FIG. 6 is a view taken at 6—6 showing the loop at the end of strut 37. This construction for the spring mechanism increases the fatigue life of the spring. FIG. 5 is a view of the end of the molded beam 30 taken at 5—5.

Incorporated in this swim fin are the following important design points which advance the state-of-the-art:

1. The swim fin is provided with a rigid blade having a blade span of 30 inches.

The length of the blade span is an important factor in determining swim fin efficiency. The blade span of the average conventional swim fin is about 9.25 inches. The use of a 30 inch blade span is made possible because this swim fin is designed for swimming using the dolphin style swimming stroke exclusively, that is, both feet move together during swimming. Therefore, there is no need for the blades to clear each other as with the conventional swimming stroke.

2. The blade configuration is designed for optimum efficiency for use with the dolphin style swimming stroke.

The leading and the trailing edges of the blade are perpendicular to the longitudinal axis of the swim fin, and in this particular model the distance between the leading and trailing edge is only 3.50 inches. In addition, the corners at the leading edge of the blade are rounded to reduce tip losses.

3. The blade is spaced from the foot pocket.

4. The hinge point for the blade is located on the leading edge.

Design points 2, 3, and 4 enable the swimmer to reverse the blade easily at the end of each stroke even though the blade span is 30 inches, the trailing edge of the blade being located only 3.50 inches from the hinge point swings in an arc having a 3.50 inch radius during blade angle reversal. The quantity and the velocity of the water moved and consequently the drag and the amount of energy needed is minimal in comparison to other blades. Heretofore, because swim fins generated so much drag during blade angle reversal the body moved excessively in reaction and little forward thrust was produced.

5. The blade support is pivotally attached to the center portion of the leading edge of the blade.

It is important to keep the blade support as short as possible to reduce drag otherwise blade angle reversal will be sluggish.

6. A compact spring mechanism provides the resilient force to the blade.

It too is designed to generate minimum drag and the spring is located away from the blade so as not to interfere with the water entering the blade.

7. To control a 30 inch blade during swimming requires a blade support that resists twisting in a torsional direction.

The blade support illustrated adequately does this with a minimum wire diameter, weight and cost. This is achieved in the following manner:

The U-shaped wire form is relatively weak but when the ends of the struts are inserted into the hinge plate, it becomes a rectangular frame that is strong in torsion. The second purpose for the hinge plate, therefore is to function as a fourth structural member for the wire form in forming a rectangular frame. Another important feature of the blade support is that when the swimmer accidentally severely twists the blade of the swim fin while walking, the wire form does not see the high stresses because the wire form does not extend beyond the toe of the foot pocket; instead, the molded beams distort but since they are made of rubber-like plastic, return to their original shape without sustaining permanent damage.

Referring to FIG. 7, the swim fin is identical to that of FIG. 4 with the exception of an optional spring mechanism. A strut 39 is attached to the blade and projects to the side of the swim fin. One end of the spring 40 is connected to a hole in the end of strut 39 and the other end to a hook 41 which is fastened to the side of the foot pocket.

My invention is not to be limited to the embodiments illustrated, which are presented for illustration, and is intended to be limited only by the scope of the appended claims.

I claim:

1. A swim fin comprising in combination:

(a) a foot pocket having a toe end;

(b) a rigid blade having a leading edge and a trailing edge;

(c) a generally U-shaped wire form having first and second legs and a cross-member;

(d) means for attaching the first and second legs of the U-shaped wire form to the foot pocket so that the cross-member of the U-shaped wire form is spaced from the toe end of the foot pocket;

(e) means for pivotally attaching the leading edge of the blade to the cross-member of the wire form;

(f) a rigid member having first and second ends, the first end being attached to the blade; and (g) means including a first extension spring having a first end connected in fixed relationship to the foot pocket and a second end connected to the second end of the rigid member for continuously resiliently resisting pivoting of the blade about a neutral position to produce a finning action producing forward thrust forces against the foot pocket during transverse displacement of the foot pocket during swimming, thereby propelling the swimmer forward.

2. The swim fin of claim 1 wherein the resilient pivot resisting means includes a second extension spring having one end connected to the second end of the rigid member and another end connected in fixed relationship to the foot pocket.

3. The swim fin of claim 2 wherein the first ends of the first and second extension springs are attached to the first and second legs, respectively.

4. The swim fin of claim 1 wherein the pivotal attaching means includes a hinge element, the cross-member of the U-shaped wire form functioning as a hinge pin engaging the hinge element.

5. A pair of swim fins comprising:

first and second swim fins each including a foot pocket having a toe section, first and second beams projecting from the toe section of the foot pocket and each having an outer end, the first swim fin including a rigid blade having a leading edge and a trailing edge, the second swim fin including a rigid blade having a leading edge and a trailing edge, the first and second swim fins each including means for attaching the center portion of the leading edge of the blade of that swim fin in pivotal relationship to the outer ends of the first and second beams of that swim fin and spaced from the toe section of the foot pocket of that swim fin, and means connected between the blade and the foot pocket of that swim fin for resiliently resisting pivoting of the blade of that swim fin about a neutral position to produce a finning action producing a forward thrust on the foot pocket during transverse displacement of the foot pocket during swimming, the leading edge of the blade of the first fin being located farther from the toe section of the first swim fin than the trailing edge of the blade of the second swim fin is located from the toe section of the second swim fin so that the leading edge of the blade of the first swim fin clears the trailing edge of the blade of the second swim fin during normal use of the pair of swim fins by a swimmer.

6. The pair of swim fins of claim 5 wherein an inner portion of the leading edge of the blade of the first swim fin is inclined rearward relative to the direction of the forward thrust and an inner portion of the trailing edge of the blade of the second swim fin is approximately parallel to and spaced from the leading edge of the blade of the first swim fin when the first and second swim fins are positioned in aligned, adjacent relationship to each other.

7. A swim fin comprising in combination:

(a) a foot pocket having a toe section;

(b) first and second beams molded to the foot pocket and projecting forward from the sides of the toe section of the foot pocket;

(c) a rigid blade having a leading edge and a trailing edge;

(d) a reinforcement frame for the first and second beams comprising a first strut, a second strut, and a cross-member constructed as a wire form, the first strut being attached to the first beam, the second strut being attached to the second beam and the cross-member being attached to the foot pocket;

(e) pivotal attachment means for the blade including a hinge plate, the ends of the first and second struts being bent 90 degrees and inserted into the hinge plate to function as a hinge pin therefor; and (f) means connected between the blade and the foot pocket for resiliently resisting pivoting of the blade about a neutral position to produce a finning action producing forward thrust against the foot pocket during transverse displacement of the foot pocket during swimming, thereby propelling the swimmer forward.

8. The swim fin of claim 7 wherein the leading and trailing edges of the rigid blade are perpendicular to the longitudinal axis of the swim fin and the corners at the leading edge are rounded.

9. The swim fin of claim 8 wherein the resilient pivot resisting means includes an extension spring and a rigid member having a first and second end, the first end of the rigid member being attached to the blade, the second end of the rigid member being formed into a loop at accept a midportion of the extension spring, a first end of the extension spring being attached to the first strut and the second end of the extension spring being attached to the second strut.

10. A swim fin comprising in combination:

(a) a foot pocket having a toe end;

(b) a rigid blade having a leading edge and a trailing edge;

(c) a generally U-shaped wire form having first and second legs and a cross-member;

(d) means for attaching the first and second legs of the U-shaped wire form to the foot pocket so that the cross-member of the U-shaped wire form is spaced from the toe end of the foot pocket;

(e) means for pivotally attaching the leading edge of the blade to the cross-member of the wire form;

(f) a rigid member having first and second ends, the first end being attached to the blade; and (g) means including an extension spring having first and second ends and a midportion, the first end being connected to the first leg and the second end being connected to the second leg, the midportion being connected to the second end of the rigid member for continuously resiliently resisting pivoting of the blade about a neutral position to produce a finning action producing forward thrust forces against the foot pocket during transverse displacement of the foot pocket during swimming, thereby propelling the swimmer forward.

* * * * *